US006438821B1

(12) United States Patent
Kojima et al.

(10) Patent No.: US 6,438,821 B1
(45) Date of Patent: Aug. 27, 2002

(54) PTC THERMISTOR AND METHOD FOR MANUFACTURING THE SAME

(75) Inventors: Junji Kojima, Hirakata; Kohichi Morimoto, Sakai; Takashi Ikeda; Naohiro Mikamoto, both of Osaka, all of (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/480,494

(22) Filed: Jan. 11, 2000

Related U.S. Application Data

(62) Division of application No. 09/331,715, filed on Jul. 23, 1999, now Pat. No. 6,188,308.

(30) Foreign Application Priority Data

Dec. 26, 1996 (JP) ..... 8-347252

(51) Int. Cl.[7] ..... H01C 7/04

(52) U.S. Cl. ..... 29/612; 29/830; 338/22 R; 338/225 D

(58) Field of Search ..... 338/22 R, 225 D, 338/328, 331, 332; 29/612, 610.1, 620

(56) References Cited

U.S. PATENT DOCUMENTS

| | | | | |
|---|---|---|---|---|
| 4,290,041 A | * | 9/1981 | Utsumi et al. | 338/21 |
| 4,689,475 A | * | 8/1987 | Kleiner et al. | 219/553 |
| 5,034,709 A | * | 7/1991 | Azumi et al. | 29/610.1 |
| 5,245,309 A | | 9/1993 | Kawase et al. | 338/22 R |
| 5,414,403 A | | 5/1995 | Greuter et al. | 338/22 R |
| 5,493,266 A | | 2/1996 | Sasaki et al. | 338/22 R |
| 5,831,510 A | | 11/1998 | Zhang et al. | 338/22 R |
| 5,874,885 A | | 2/1999 | Chandler et al. | 338/22 R |

FOREIGN PATENT DOCUMENTS

| | | | |
|---|---|---|---|
| GB | 1337929 | | 11/1973 |
| JP | 61-10203 | * | 1/1986 |
| JP | 63-87705 | | 4/1988 |
| JP | 63-117416 | | 5/1988 |
| JP | 63-300507 | | 12/1988 |
| JP | 4-65427 | | 6/1992 |
| JP | 5299201 | | 11/1993 |

* cited by examiner

*Primary Examiner*—Carl J. Arbes
*Assistant Examiner*—Sean Smith
(74) *Attorney, Agent, or Firm*—Parkhurst & Wendel, LLP

(57) ABSTRACT

The present invention aims to provide a PTC thermister which uses a conductive polymer having a positive temperature coefficient and has a high withstand voltage and high reliability and in which no failure in electrical connection occurs in side electrode even when a mechanical stress occurs due to the thermal shock by repeated thermal expansion of the conductive polymer sheet. It also aims to provide a method to manufacture the above PTC thermister. To achieve the above purpose, the PTC thermister of the present invention comprises (1)a laminated body made by alternately laminating conductive polymer sheets and inner electrodes, (2) outer electrodes disposed on tops and bottoms of said laminated body and (3) multi-layered side electrodes disposed at the center of both sides of said laminated body and is electrically coupled with said inner electrodes and said outer electrodes. And, a side of laminated body having an area on which a side electrode layer is formed and areas on which side electrode is not formed. A method for manufacturing a PTC thermistor comprises the steps of (1) forming a laminated body by sandwiching a conductive polymer sheet with metal foils, and then integrating them by heat pressing, (2) sandwiching the laminated body and conductive polymer sheets from the top and bottom by metal foils, and integrating them by heat pressing. A multi-layered PTC thermistor is obtained by repeating above processes.

2 Claims, 8 Drawing Sheets

PRIOR ART

PTC THERMISTOR AND METHOD FOR MANUFACTURING THE SAME

This is a Division of application Ser. No. 09/331,715 filed Jul. 23, 1999 now Pat. No. 6,188,308.

FIELD OF THE INVENTION

The present invention relates to the PTC thermistors in which a conductive polymer material having a positive temperature coefficient (PTC) of resistance is employed, and methods for manufacturing the same.

BACKGROUND OF THE INVENTION

PTC thermistors have been commonly used in self-regulating heaters, and are increasingly employed in electronic devices as components to protect against overcurrent. Exposure to overcurrent in an electric circuit causes the conductive polymer sheet inside a PTC thermistor to heat up and expand. This thermal expansion of the conductive polymer sheet increases the resistance of the PTC thermistor and thus reduces the current to a safer level. There are, increasing demands for PTC thermistors which carry high currents, have low resistance, are compact in size, and yield a low voltage drop.

A conventional PTC thermistor is described below.

One known PTC thermistor is disclosed in the Japanese Laid-open Patent No. S61-10203. This PTC thermistor is created by laminating a plurality of alternate layers of conductive polymer sheets and metal foils, with side electrodes on opposing sides.

FIG. 10 is a sectional view of a conventional PTC thermistor. In FIG. 10, a conductive polymer sheet 1 is made of a high polymer material, such as cross-linked polyethylene, and dispersed conductive particles, such as carbon black. An inner electrode 2 is made typically of a sheet of metal foil, and is sandwiched between the conductive polymer sheets 1. The inner electrode 2 is also disposed on the top and bottom of the conductive polymer sheet 1, while leaving a no electrode area 3 at the starting end, portions of the middle and finishing ends of the conductive polymer sheet 1 as shown. Alternate layers of the inner electrode 2 and conductive polymer sheet 1 form a laminated body 4. A side electrode layer 5 form a leader section, and is disposed at the side of the laminated body 4 so as to be electrically coupled to one end of the inner electrode 2.

However, the conventional PTC thermistor created by laminating the conductive polymer sheet 1 and inner electrode 2 alternately to create low resistance undergoes repetitive expansion and shrinkage of the conductive polymer sheet 1 when an overcurrent condition is created and alleviated. This may cause failure in connections to the side electrode due to cracking generated as a result of stresses generated by the expansion and contraction of the conductive polymer sheet 1.

The present invention aims to provide a highly reliable PTC thermistor with good withstand voltage which eliminates failure in a connection to a side electrode by cracks, and its manufacturing method.

SUMMARY OF THE INVENTION

The PTC thermistor of the present invention comprises:

A laminated body made by alternately laminating a conductive polymer sheet and an inner electrode;

an outer electrode disposed on a top and a bottom of the laminated body; and a multi-layered side electrode disposed at the center of a side of the laminated body, and electrically coupled with the inner electrode and the outer electrode.

A side of the laminated body has:

i) an area on which the side electrode is disposed and ii) an area on which the side electrode is not disposed.

In a method for manufacturing the PTC thermistor of the present invention, the conductive polymer sheet is sandwiched from the top and the bottom by metal foils and integrated by heat pressing to form the laminated body. The laminated body is then sandwiched from the top and the bottom by other conductive polymer sheets, and the laminated body and the conductive polymer sheets are sandwiched from the top and the bottom by the metal foils. They are integrated by heat pressing. These processes are repeated for lamination.

In the PTC thermistor as configured above, a side electrode comprises multiple layers and is disposed at the center of the side of the laminated body so as to be electrically coupled to the inner electrodes and the outer electrodes. In addition, the side of the laminated body has areas with and without the side electrode. This feature reduces mechanical stress in the side electrode at the boundary of the multiple layers of the side electrode layer even when mechanical stress due to thermal impact is applied to the side electrode through repetitive thermal expansion of the conductive polymer sheet during operation of the PTC thermistor. Mechanical stress in the side electrode may also be reduced by extrusion of an expanded conductive polymer sheet to an area where the side electrode is not formed. Thus, generation of cracks by concentrated mechanical stress is avoided, thereby eliminating failure in an electrical connection by cracks. In a method for manufacturing PTC thermistors of the present invention, a process to integrate the laminated body, conductive polymer sheet, and metal foil by heat pressing is repeated for lamination. This process allows uniform thickness of the conductive polymer sheet in each layer to be achieved. Accordingly, a highly reliable PTC thermistor with good withstand voltage is obtained.

DESCRIPTION OF THE PREFERRED EMBODIMENTS

First Exemplary Embodiment

A PTC thermistor in a first exemplary embodiment of the present invention is described with reference to drawings.

Figure 1A:
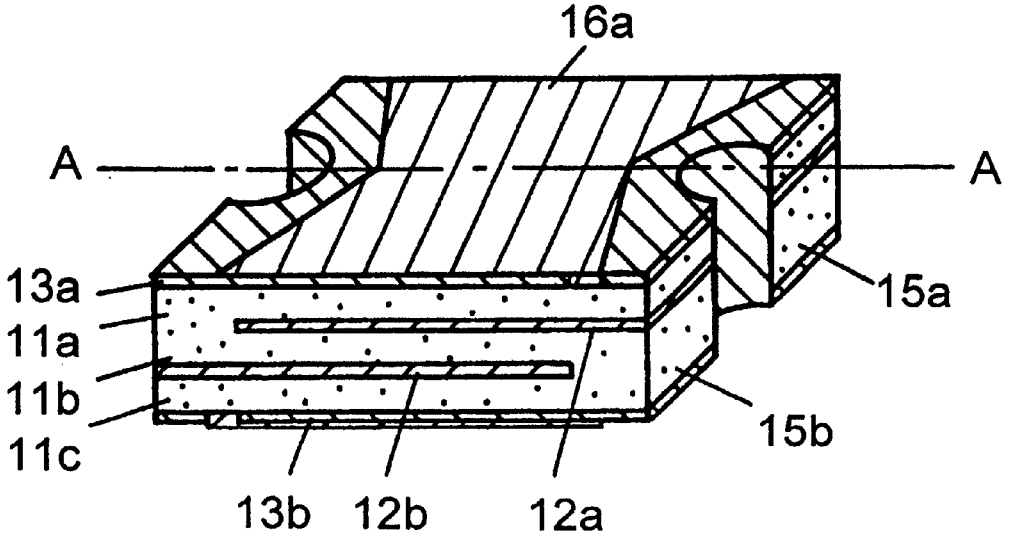
FIG. 1A is a perspective view of a PTC thermistor in accordance with a first exemplary embodiment of the present invention.
Figure 1B:
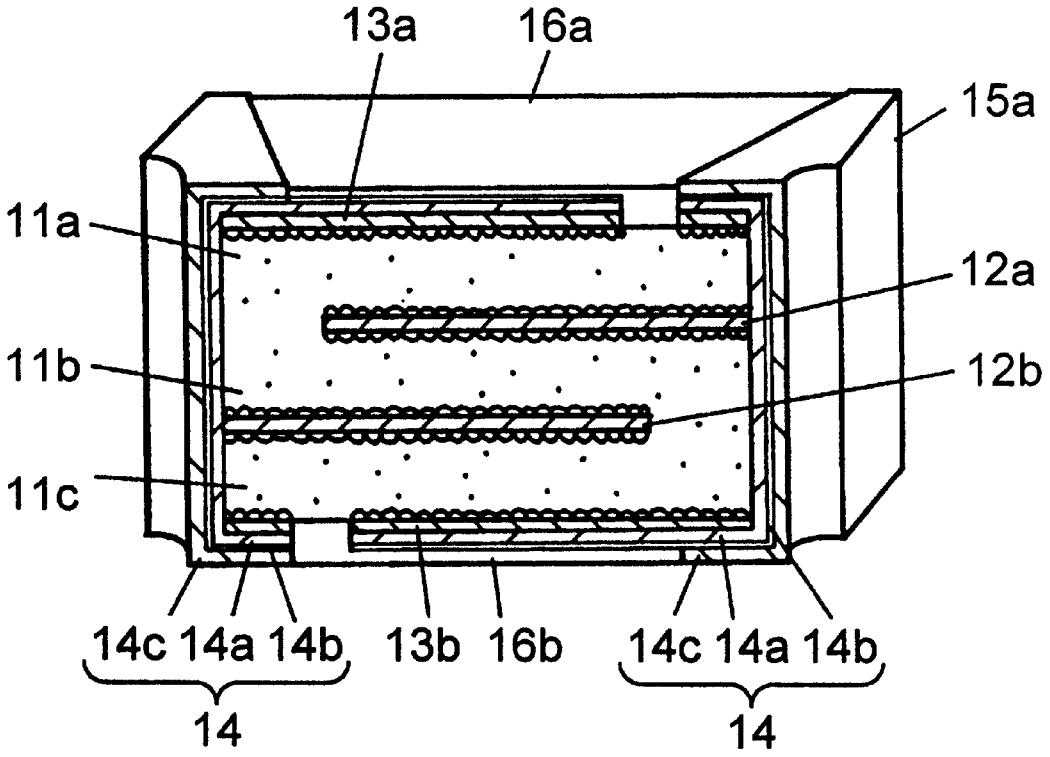
FIG. 1B is a magnified sectional view of a PTC thermistor in accordance with the first exemplary embodiment.
Figure 2:
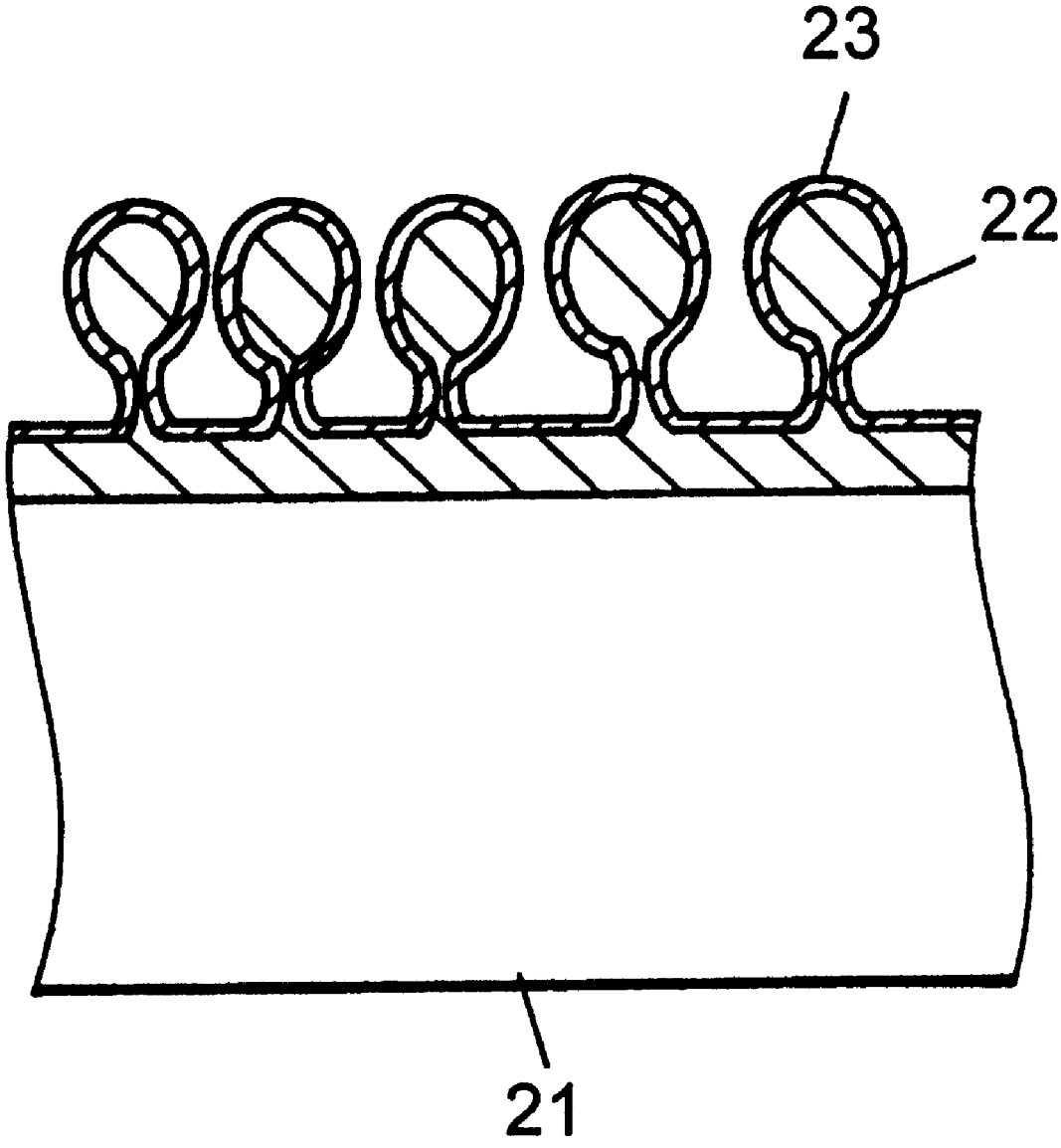
FIG. 2 is a magnified sectional view of a surface of a copper foil used for an inner electrode of the PTC thermistor.

FIG. 1A is a perspective view of the PTC thermistor in the first exemplary embodiment of the present invention. FIG. 1B is a magnified sectional view taken along Line A—A in FIG. 1A. In FIGS. 1A and 1B, conductive polymer sheets 11*a*, 11*b*, and 11*c* are made of a mixed compound of high density polyethylene, i.e. a crystaline polymer, and carbon black, i.e. conductive particles. Inner electrodes 12*a* and 12*b* are made of copper foil, and have nickel protrusions 22 in the form of swelling on a short stalk on both surfaces. To show the image of a protrusion, an enlarged sectional view of one side of the foil is shown in FIG. 2.

A protective nickel coating layer 23 is plated over the nickel protrusions 22. The inner electrodes 12*a* and 12*b* are sandwiched between the conductive polymer sheets 11*a*, 11*b*, and 11*c*, respectively. Outer electrodes 13*a* and 13*b* made of a copper foil are disposed on the outermost layers of a laminated body, and have nickel protrusions in the form of swelling on a short stalk on the contacting surface to the conducive polymer sheets 11*a* and 11*c*. A protective nickel coating layer 23 is plated over the nickel protrusions. A first side electrode layer 14*a*, second side electrode layer 14*b*, and third side electrode layer 14*c* are disposed at the center of both opposing ends of the laminated body fabricated by laminating the conductive polymer sheets 11*a*, 11*b*, and 11*c*, the inner electrodes 12*a* and 12*b*, and the outer electrodes 13*a* and 13*b*. The inner electrodes 12*a* and 12*b* and the outer electrodes 13*a* and 13*b* are electrically coupled alternately to the opposing side electrodes 14. No side electrode layer areas 15*a* and 15*b* are parts on which the side electrode layer 14 is not formed. These are disposed on the ends of the laminated body, on which the side electrode 14 is formed, at both sides of the side electrode 14. The first side electrode layer 14*a* is a first nickel plated layer, the second side electrode layer 14*b* is a copper plated layer, and the third side electrode layer 14*c* is a second nickel plated layer. The side electrode 14 is formed by laminating these plated layers in the above order. A first epoxy insulating coating resin layer 16*a* and a second epoxy insulating coating resin layer 16*b* are disposed on the outermost layers of the laminated body.

A method for manufacturing the PTC thermistor in the first exemplary embodiment of the present invention as configured above is described next with reference to FIG. 3.

First, 35 $\mu$m thick copper foil 31 is plated in a Watts nickel bath at a current density about 4 times higher (20 A/dm$^2$) than normal plating so as to plate nickel protrusions having height of 5–10 $\mu$m. Then, an approximately 1 $\mu$m thick nickel coating film is plated at normal current density (about 4 A/dm$^2$). The copper foil 31, after being plated with the nickel protrusions and nickel coating film, is patterned by means of a die press. The pattern may also be made by means of the photolithography and etching process.

Next, 50 wt.% of high density polyethylene of 70 to 90% crystallinity, 50 wt.% of furnace black having average particle diameter of 58 nm and specific surface area of 38 m$^2$/g , and 1 wt.% of antioxidant are mixed and dispersed for about 20 minutes using two roll mills heated to about 150° C. to fabricate conductive polymer sheet 32 of about 0.3 mm thick.

Figure 3A:
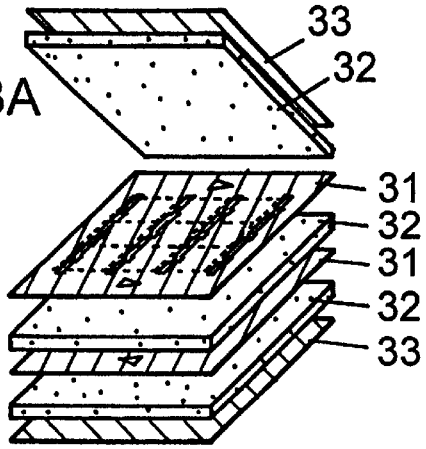
FIGS. 3A–H illustrate a method for manufacturing the PTC thermistor in the first exemplary embodiment of the present invention.

Then, as shown in FIG. 3A, the three conductive polymer sheets 32 and two patterned copper foils 31 are stacked alternately so as to ensure that the opening on the copper foil sheets 31 alternately appear at opposite sides. This stacked body is then sandwiched from the top and bottom by plain copper foil sheets 33 which have nickel protrusions and a nickel coating layer for protecting the nickel protrusions only on the contacting surface to the conductive polymer sheets 32.

Figure 3B:
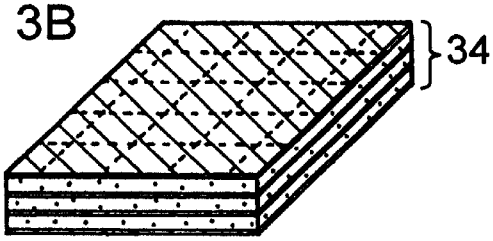

As shown in FIG. 3B, after stacking the layers, they are heat pressed at about 175° C., in a vacuum of about 20 torr, and under the pressure of about 50 kg/cm$^2$ for about 1 minute using a vacuum heat press to make an integrated laminated body 34.

Figure 3C:
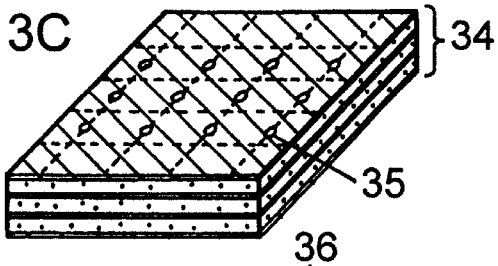
Figure 3D:
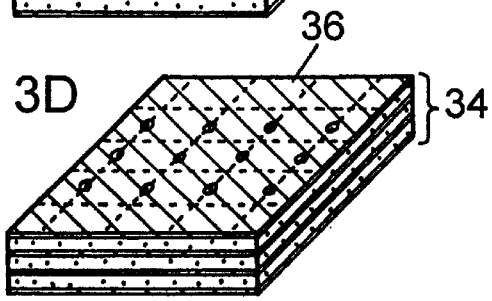

As shown in FIG. 3C, a plurality of through holes 35 is are formed on the laminated body 34 using a drilling machine. The through holes 35 may also be created using. a die press. Then, an about 40 Mrad electron beam is applied the laminated body in an electron beam irradiation equipment to crosslink the high density. polyethylene.

Next, as shown in FIG. 3D, 10–20 $\mu$m thick nickel film is plated on the entire laminated body 34 including the through hole 35 by dipping the laminated body 34 in the Watts nickel bath for about 30 minutes at normal current density (about 4A/dm$^2$). Then, 5–10 $\mu$m thick copper film is plated in a copper sulfate plating bath for about 10 minutes, completing the multi-layered plated film 36. Adding 0.5 vol. % of wetting agent to the nickel sulfate solution allows a plated layer to be formed uniformly onto the inner wall of the through hole 35. A film with little residual stress, which reaches up to 20,000–30,000 psi with conventional plating solution, is thus achieved.

Figure 3E:
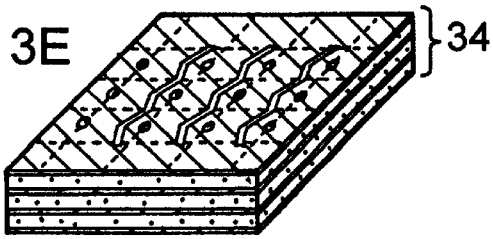

Next, as shown in FIG. 3E, a copper foil 33 on the outermost layer and the multi-layered plated film 36 are patterned. The following process is employed for forming the pattern. A dry film is laminated to both surfaces of the laminated body 34. After UV exposure of the etching pattern and development, the plated film is chemically etched using iron chloride, following which the dry film is peeled off. Instead of a dry film, an etching resist may also be formed by screen printing.

Figure 3F:
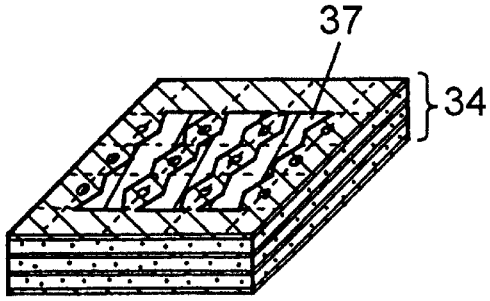

Next, as shown in FIG. 3F, epoxy resin paste is screen printed onto both surfaces of the laminated body 34 except for around the through hole 35. It is then thermally cured at 150° C. for 30 minutes to form a protective coating resin layer 37. This protective coating resin layer 37 may also be formed by laminating an insulation resist film and patterning using the photolithography and etching process.

Figure 3G:
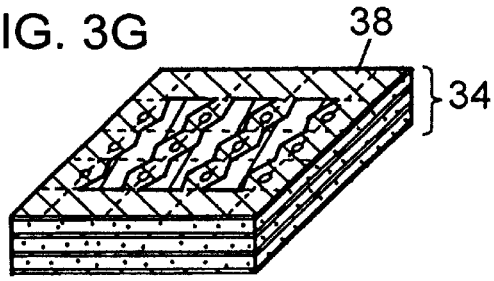

Then, as shown in FIG. 3G, a 5–10 $\mu$m thick nickel film 38 is plated on the top and bottom of the laminated-body 34 on the areas where the protective coating resin layer 37 has not been formed and on the inner wall of the through hole 35, at a current density of about 4A/dm$^2$ for 10 minutes.

Figure 3H:
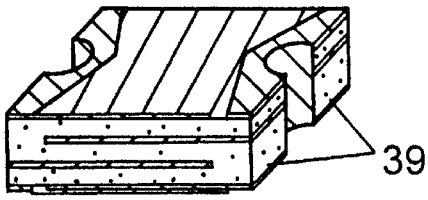

As shown in FIG. 3H, the laminated body 34 is then divided into pieces by dicing. The die press method is also applicable for dividing the laminated body 34. The laminated body 34 has no side electrode areas 15*a* and 15*b* on its opposing ends. The side electrode is located at the center of the ends, and the no side electrode area 39, comprising the no side electrode areas 15*a* and 15*b*, are provided on both sides of the side electrode layers on both ends of the laminated body 34. The PTC thermistor of the present invention is now completed.

Since the inner electrodes 12*a* and 12*b* are formed of copper foil, the ends of the copper foil constituting the inner electrodes 12*a* and 12*b* may be activated easily by pretreatment such as acid washing to form the side electrode 14. This enables inner electrodes 12*a* and 12*b* to have improved connection with the nickel plated first and third side electrode layers 14*a* and 14*c*. The inner electrodes 12*a* and 12*b* have nickel protrusions 22 on the contacting surface to the conductive polymer sheets 11*a*, 11*b*, and 11*c*. A nickel coating layer 23 for protecting the nickel protrusions 22 is also provided. This structure allows the shape of the nickel protrusions 22 to be maintained throughout the heat pressing process. The strong adhesion between the conductive polymer sheets 11*a*, 11*b*, and 11*c*,and the inner electrodes 12*a* and 12*b*, the outer electrodes 13*a* and 13b can be created by an anchor effect due to the nickel protrusions 22.

The reliability of the thickness of the side electrode 14, a key part of the PTC thermistor in the first exemplary embodiment of the present invention as configured and manufactured above, is described next.

Figure 4A:
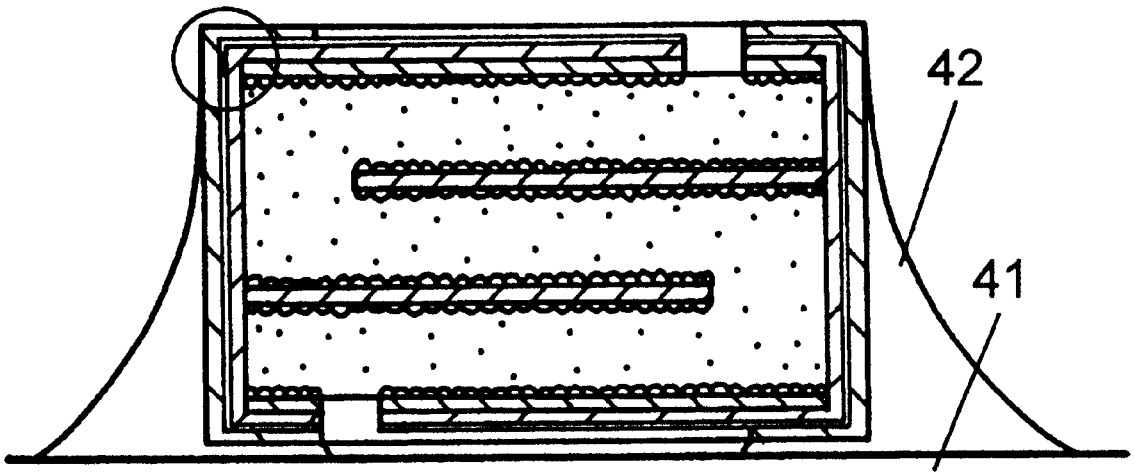
FIG. 4A is a sectional view of an example of a crack generated in the side electrode during a thermal impact test.
Figure 4B:
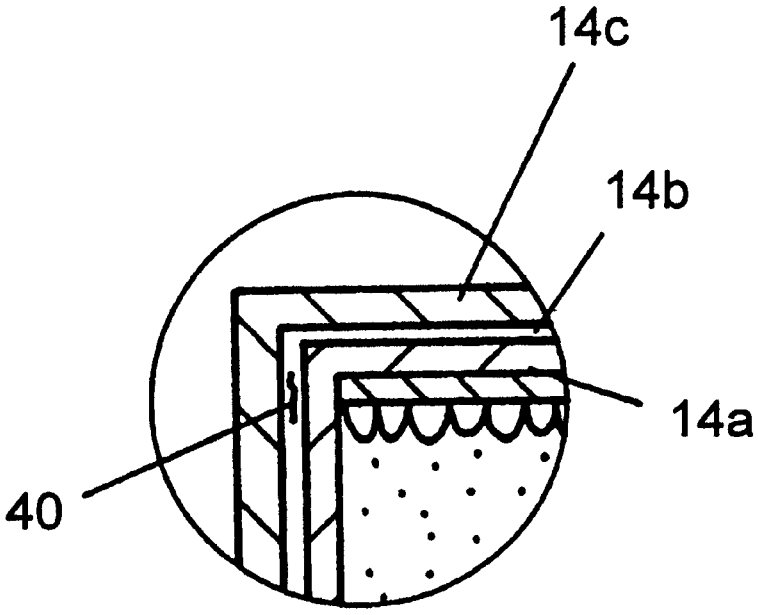
FIG. 4B is a magnified sectional view of a crack generated in the side electrode during a thermal impact test.

The first exemplary embodiment of the present invention is compared with Comparison A and Comparison B . The PTC thermistor in this exemplary embodiment has a three-layered side electrode 14 which comprises a 15 $\mu$m first nickel plated layer which constitutes the first side electrode layer 14*a* , a 5 $\mu$m copper plated layer which constitutes the second side electrode layer 14*b*, and a 5 $\mu$m second nickel plated layer which constitutes the third side electrode layer 14*c*. The PTC thermistor in Comparison A has a side electrode layer, a key part, formed by single plating of 25 $\mu$m thick nickel. The PTC thermistor in Comparison B has a side electrode layer, a key part, formed by single plating layer of 25 $\mu$m thick copper. For the comparison, 30 pieces of each type of the PTC thermistors were mounted on printed circuit boards before the trip cycle test. In the test, a 25 V DC power was connected in series. An overcurrent of 100 A was supplied for one minute, and then stopped for 5 minutes. After 1,000 cycles, 10,000 cycles, and 30,000 cycles of the trip cycle test, 10 pieces were sampled from each type, and investigated by cross-sectional observation for the presence of any cracks 40 in the side electrode layer as shown in FIG. 4B.

No cracks were observed after 1,000 or 10,000 cycles in the PTC thermistor in the exemplary embodiment of the present invention. After 30,000 cycles, however, a crack was found in 1 of the 10 pieces. As shown in FIG. 4, this crack had found in the second side electrode layer 14*b* of the copper plating, and had propagated to a minor degree laterally along the second side electrode layer 14*b*, but not as far as the boundary. The crack had not reached to the third side electrode layer 14*c*, which is made of the second nickel plating layer.

In case of the PTC thermistor in Comparison A, a crack was found in 2 out of 10 pieces after 1,000 cycles. The cracks had reached to within 5 $\mu$m of where a connection failure would occur. After 10,000 cycles, cracks had caused connection failure in all 10 pieces.

In the case of the PTC thermistor in Comparison B, cracks were found in all 10 pieces after 1,000 cycles. Moreover, connection failure had occurred in 4 pieces. After 10,000 cycles, connection failure had occurred in all 10 pieces.

The above comparison results indicate that the PTC thermistor in the exemplary embodiment of the present invention can reduce the inner stress in the side electrode. Even though the multi-layered PTC thermistor has greater volumetric expansion, compared to a single-layer structure, in proportion to the number of laminated layers when thermal expansion of the conductive polymer sheets 11*a*, 11*b*, and 11*c* occurs as a result of self-heating when an overcurrent condition exists. With regard to volumetric expansion in the lateral direction of the laminated body, the expanded conductive polymer is extruded to a part where no side electrode layer is formed. This enables the reduction of stress on the side electrode layer.

In addition, with regard to volumetric expansion in the vertical direction of the laminated body, cracks stopped at the boundary between the first side electrode layer 14*a* and second side electrode layer 14*b*, preventing connection failure in the side electrode layer, even when a stress is concentrated on a corner of the side electrode layer. This is because the plated layers of the side electrode layer of the PTC thermistor comprise the first side electrode layer 14*a* made of high-tensile strength nickel, and the second side electrode layer 14*b* formed of ductile copper.

More specifically, the stress concentrated on the corner of the side electrode layer may be reduced at the boundary between the first side electrode layer 14*a* and second side electrode layer 14*b* in the multi-layered side electrode. The third side electrode layer 14*c*, formed of the second nickel plated layer prevent soldering leaching during mounting the PTC thermistor onto a printed circuit board 41 with solder 42. Accordingly, durable electrical connection of the side electrode configured by plating three layers of nickel, copper and nickel is confirmed.

Second Exemplary Embodiment

Figure 5A:
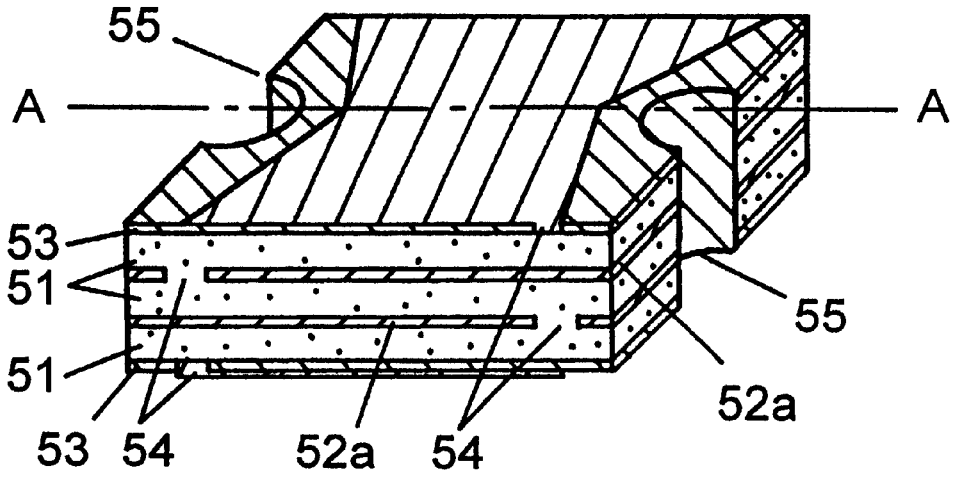
FIG. 5A is a perspective view of a PTC thermistor in accordance with a second exemplary embodiment of the present invention.
Figure 5B:
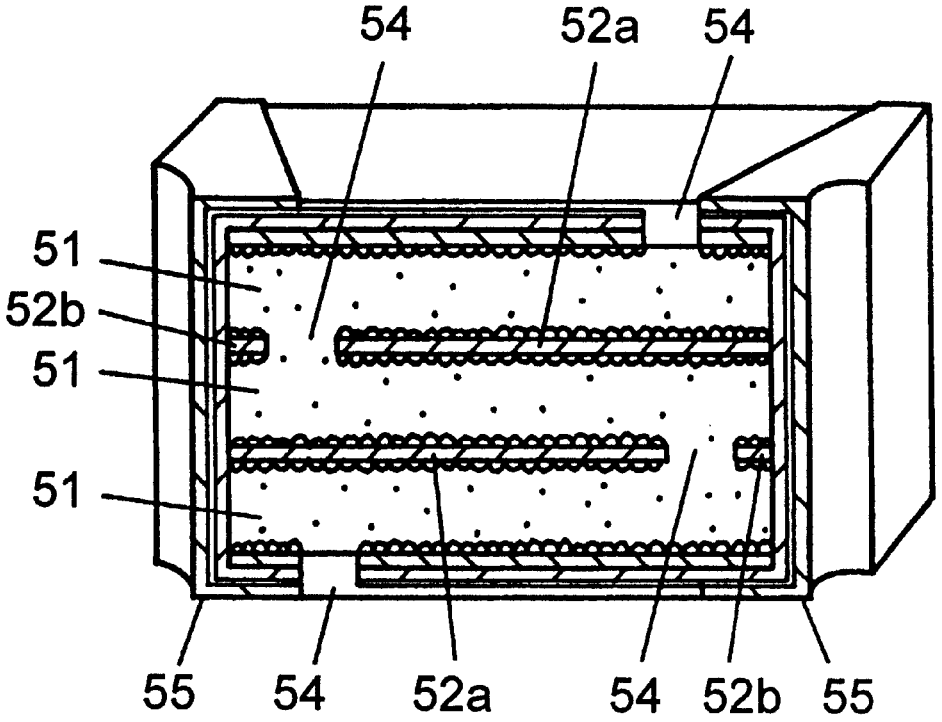
FIG. 5B is a magnified sectional view of a PTC thermistor in accordance with a second exemplary embodiment of the present invention.

The configuration of a PTC thermistor in a second exemplary embodiment of the present invention is described with reference to the drawings. FIG. 5A is a perspective view and FIG. 5B is a sectional view of the PTC thermistor. In FIGS. 5A and 5B, a conductive polymer sheet 51 is made of a mixed compound of high density polyethylene, i.e. a crystaline polymer, and carbon black, i.e. conductive particles. Inner electrodes 52*a* and 52*b* are made of a copper foil, and are laminated alternately with the conductive polymer sheet 51. An outer electrode 53 is made of a copper foil. An opening 54 is a space provided near one side electrode 55 to divide the inner layer into the inner electrodes 52*a* and 52*b*. The side electrode 55 is connected to the inner electrodes 52*a* and 52*b* and the outer electrode 53. The opening 54 is created near one side electrode 55, and is provided near the alternate side in each layer.

The second exemplary embodiment of the present invention differs from the first exemplary embodiment in that the inner electrode is divided into two parts, i.e., the inner electrodes 52*a* and 52*b* by the opening 54 at near one side electrode 55. In other words, the inner electrode comprises longer inner electrode 52*a* toward one side electrode layer 55 and shorter inner electrode 52*b* toward the other side electrode 55.

The PTC thermistor having the three-layered side electrode is manufactured using the method described in the first exemplary embodiment. More specifically, a first side electrode layer 14*a* is made of 15 $\mu$m thick first nickel plated layer, a second side electrode layer 14*b* is made of 5 $\mu$m copper plated layer, and a third side electrode layer 14*c* is made of a 5 $\mu$m thick second nickel plated layer. Then, 30 pieces of this type of PTC thermistor are mounted on printed circuit boards. Mounted PTC thermistors are connected to a 25-V DC power in series, and the trip cycle test applying 100

A overcurrent (ON for 1 minute, and OFF for 5 minutes) was implemented. After 1,000, 10,000, and 30,000 cycles, 10 pieces were sampled and investigated by cross-sectional observation for the electrical connections to the side electrode. No cracks were observed in the PTC thermistor of the present invention after 1,000, 10,000, and 30,000 cycles.

In this exemplary embodiment, the inner electrodes 52*a* and 52*b* are connected to both side electrode layers 55 on opposing sides of the laminated body. In addition, the inner electrodes 52*a* and 52*b* are divided into two parts by the opening 54 disposed near one side electrode layer 55. Elongation of the conductive polymer sheet in a vertical direction of the laminated body due to volumetric expansion of the conductive polymer sheet 51 during operation is thus prevented by the inner electrode 52*b* connected to the side electrode 55. Accordingly, the stress on corners due to vertical elongation may be reduced.

The present invention has a configuration that the inner electrodes 52*a* and 52*b* are connected to the side electrode 55 on both opposing ends of the laminated body. And the opening 54 disposed near one side electrode layer 55 divides the inner electrode 52 into the inner electrodes 52*a* and 52*b*. This configuration enables the prevention of expansion related to increase in the thickness of the conductive polymer sheet 51 near the side electrode layer 55, resulting in reducing mechanical stress on electrical connection to the side electrode 55. Accordingly, electrical connection of the inner electrodes 52*a* and 52*b* with the side electrode layer 55 may be secured.

Furthermore, in the manufacture of the PTC thermistor, the interval between the anode and cathode in the plating bath is reduced to a half for plating multi-plated layers as the side electrode layer 55. By reducing the interval between the two plating electrodes, the plating thickness of the corners of the side electrode 55 increased. Since mechanical stress is likely to be concentrated on corners where the outer electrode and side electrode layer 55 contact, the strength of the plated film of the side electrode layer 55 can be improved by increasing the thickness of the side electrode layer particularly at the corners.

Third Exemplary Embodiment

A method for manufacturing a PTC thermistor in a third exemplary embodiment of the present invention is described with reference to sectional views of the PTC thermistor shown in FIGS. 6A to 6D.

FIGS. 6A to 6D show the manufacturing method up to the lamination process of a conductive polymer sheet and metal foil, which is a key part of the PTC thermistor in the third exemplary embodiment of the present invention.

Figure 6A:
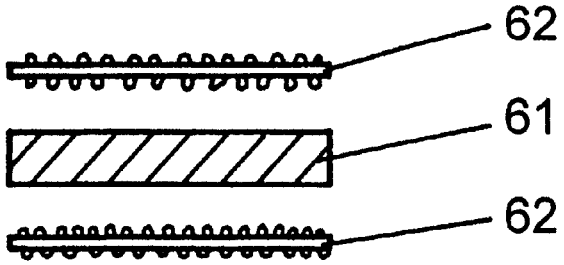
FIGS. 6A–D illustrate a method for manufacturing the PTC thermistor in accordance with a third exemplary embodiment of the present invention.

As shown in FIG. 6A , a conductive polymer sheet 61 is made of a mixed compound of 50 wt. % of high density polyethylene of a 70 to 90% crystallinity and 50 wt. % of carbon black having average particle diameter of about 58 nm and specific surface area of about 38 $m^2/g$. This conductive polymer sheet 61 is sandwiched between a pair of metal foils 62 made of a copper foil having nickel protrusions on both sides and nickel coating layer for protecting the nickel protrusions.

Figure 6B:
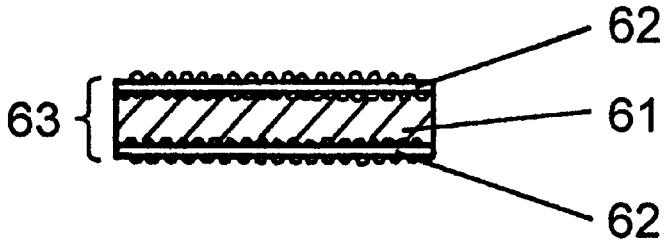

Next, as shown in FIG. 6B, the conductive polymer sheet 61 and the pair of metal foils 62 stacked in the previous process are heat pressed for 1 minute at a heating plate temperature of about 175° C. which is about 40° C. higher than the melting point of the polymer, in a vacuum of about 20 torr, and under a pressure of about 50 $kg/cm^2$, so as to make a first laminated body 63.

Figure 6C:
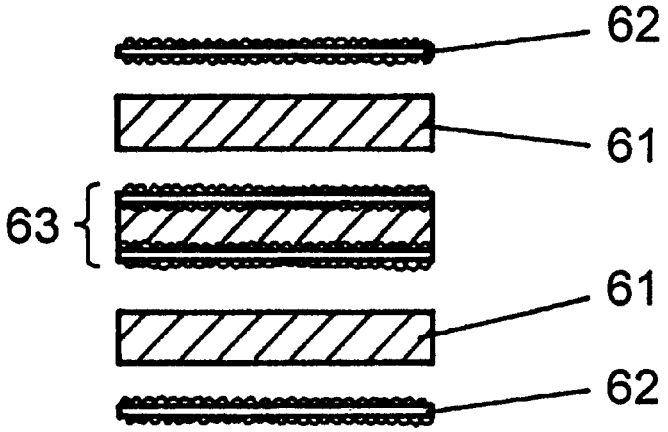

As shown in FIG. 6C, the first laminated body 63 is sandwiched from the top and bottom by a pair of conductive polymer sheets 61. Then they are further sandwiched from the top and bottom by a pair of metal foils 62 made of copper foils having nickel protrusions and nickel coating layer for protecting the nickel protrusions.

Figure 6D:
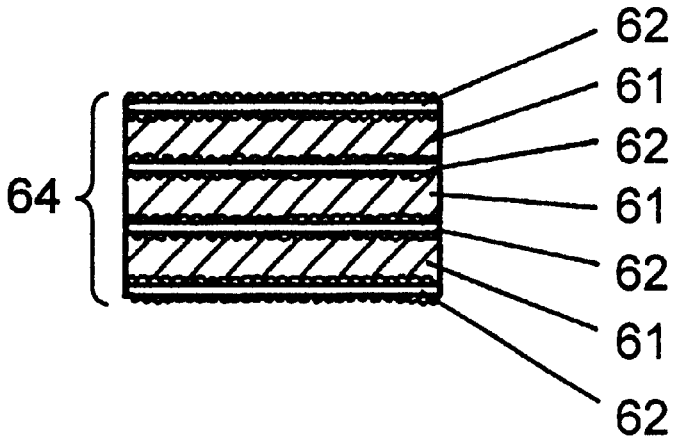

As shown in FIG. 6D, the first laminated body 63, a pair of conductive polymer sheets 61, and a pair of metal foils 62 stacked in the previous process are heat pressed for 1 minute at a heating plate temperature of about 175° C., in a vacuum of about 20 Torr, and under the pressure of about 50 $kg/cm^2$, so as to make a second laminated body 64.

To increase the number of laminated layers, the processes shown in FIGS. 6C and 6D are simply repeated.

The remaining process for manufacturing the PTC thermistor is a process to form a side electrode layer. This is manufactured according to the method described in the first and second exemplary embodiments.

In the third exemplary embodiment of the present invention, the laminated body is fabricated by using a conductive polymer sheet with a thickness of 0.27 mm. This enables the PTC thermistor having uniform 0.25 mm thick conductive polymer layers.

The thickness of the conductive polymer of the PTC thermistor after lamination is described as follows based on the reliability test results.

The laminated body was manufactured according to the manufacturing method of the present invention, using a conductive polymer sheet with a thickness of 0.27 mm before lamination. The thickness of the conductive polymer sheet in each layer of the laminated body was uniformly close to 0.25 mm in all layers.

As for comparison, a PTC thermistor was manufactured using three conductive polymer sheets with a thickness of 0.27 mm each before lamination, and four sheets of metal film. Conductive polymer sheets and metal foils were alternately stacked, and heat pressed together at the same temperature, in the same vacuum, and under the same pressing conditions as for the third exemplary embodiment of the present invention. The thickness of the conductive polymer sheet in each layer of laminated body made according to the comparison manufacturing method was, from the bottom layer, 0.21 mm, 0.27 mm, and 0.20 mm respectively. It was found that the outer layer was thinner than the inner layer.

When a number of conductive polymer sheets and metal foil sheets are integrated by heat pressing at the same time, the heat travels from the outer conductive polymer sheet contacting the heating plate to the inner conductive polymer sheet. Due to the influence of this heat conduction, the outer polymer sheet becomes thinner compared to the inner conductive polymer sheet in case of simultaneous heat pressing, because of the lower viscosity of the outer conductive polymer sheet compared to that of the inner conductive polymer sheet.

Next, a comparison of dielectric breakdown behavior is described.

Two types of PTC thermistors manufactured using different lamination methods as described above were connected to a 50 V DC power supply in series and subjected to a trip cycle test involving one minute of 100 A overcurrent followed by five minutes of cut-off. The PTC thermistor manufactured according to the present invention showed no abnormality after 10,000 cycles. The PTC thermistor manufactured according to the comparison method showed dielectric breakdown after 82 cycles.

Figure 7:
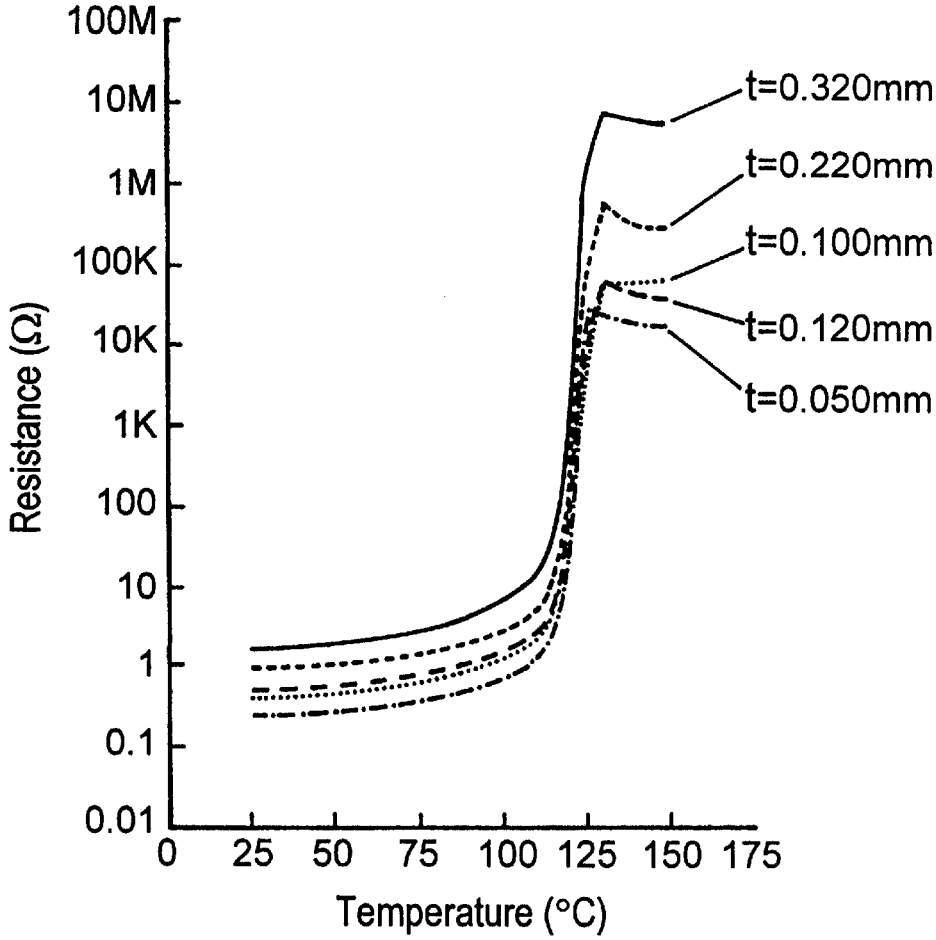
FIG. 7 is a temperature-resistance graph of conductive polymer sheets with different thicknesses.
Figure 8:
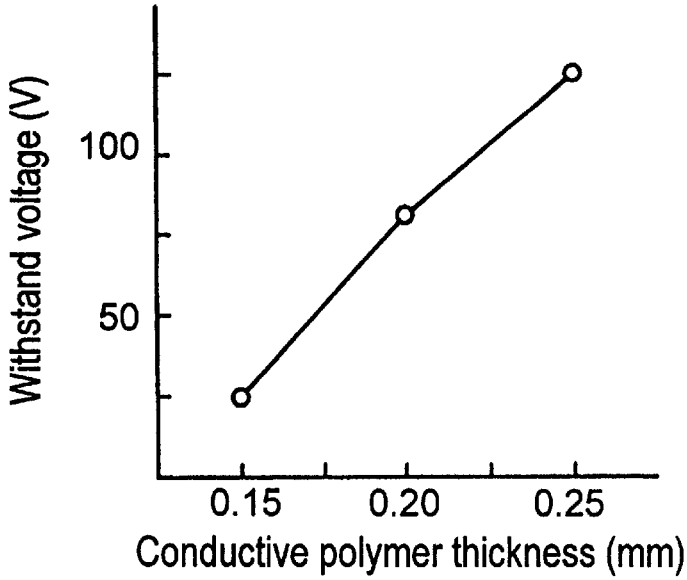
FIG. 8 is a withstand voltage characteristic graph against thickness of a conductive polymer.

Dielectric breakdown occurred in the PTC thermistor manufactured according to the comparison method due to variations in the thickness of the conductive polymer sheets. FIG. 7 shows a graph illustrating the measurements of temperature against resistance for different thicknesses of the conductive polymer of the PTC thermistor made of the same substances. FIG. 8 shows measurements of the withstand voltage of the PTC thermistors. It is apparent from the results in FIGS. 7 and 8 that thinner conductive polymer has a smaller degree of resistance increase and a lower withstand voltage. The results of the aforementioned trip cycle test indicate that the PTC thermistor manufactured according to the comparison method have caused a concentration of overcurrent on the thinner conductive polymer portions, resulting in dielectric breakdown.

Here, the manufacturing method of the present invention comprises the steps of: sandwiching a conductive polymer sheet from the top and the bottom by a pair of metal foils; heat pressing the conductive polymer sheet and metal foils for forming an integrated laminated body; sandwiching the laminated body from the top and the bottom by the conductive polymer sheets, and further sandwiching these conductive polymer sheets from the top and the bottom by metal foils; and then heat pressing the laminated body, conductive polymer sheets, and metal foils for integration. By repeating these steps, conductive polymers with uniform thickness in all layers can be obtained, achieving a PTC thermistor with good withstand voltage.

Next, a comparison between PTC thermistors provided with and without a nickel coating layer on the nickel protrusions which take the form of swelling on a short stalk, a key part of the present invention, and are formed on the surface of the metal foils is explained.

The method for treating the metal foil surface in the present invention is as follows. The copper foil 21 is plated in the Watts nickel bath at four times more current density ($20A/dm^2$) compared with normal to plate nickel protrusions with a height of between 5 and 10 $\mu$m. About a 1 $\mu$m thick nickel coating film is formed at normal current density ($4A/dm^2$).

For comparison, copper foil with nickel protrusions without a protective film was manufactured.

The metal foil with nickel protrusions has an anchoring effect between the conductive polymer sheet and the metal foil. The metal foil of the present invention which has nickel plating over the nickel protrusions in the form of swelling on a short stalk showed no deformation of the nickel protrusions caused by pressure during heat pressing. However, the metal foil of the comparison showed deformation in the nickel protrusions in the form of swelling on a short stalk due to the pressure applied to them during heat pressing. The shape of the swelling-on-stalk nickel protrusions is formed by abnormal deposition during plating. Therefore, these protrusions are fragile. The provision of nickel coating film thus prevents deformation of the nickel protrusions caused by polymer pressure.

Figure 9:
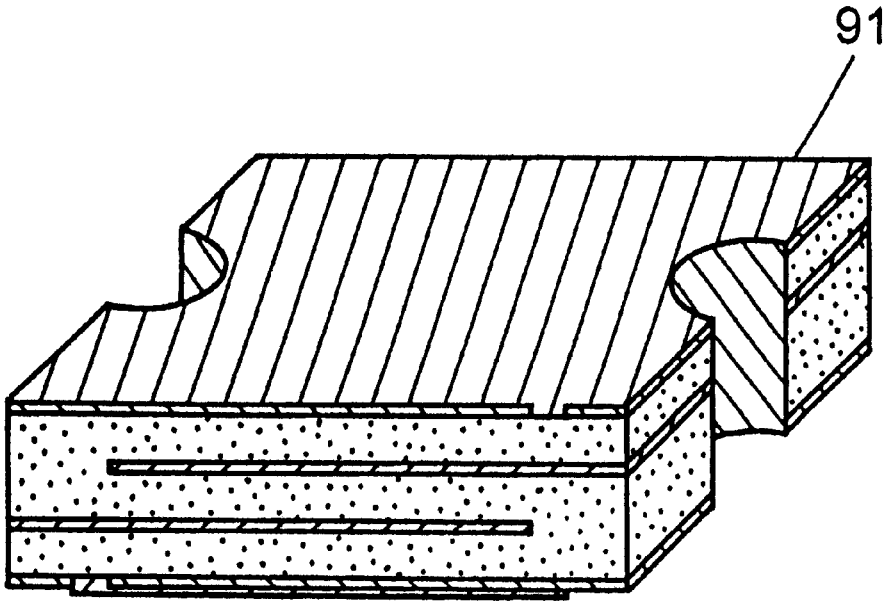
FIG. 9 is a perspective view of a PTC thermistor chip in which a protective film is provided on its entire top.
Figure 10:
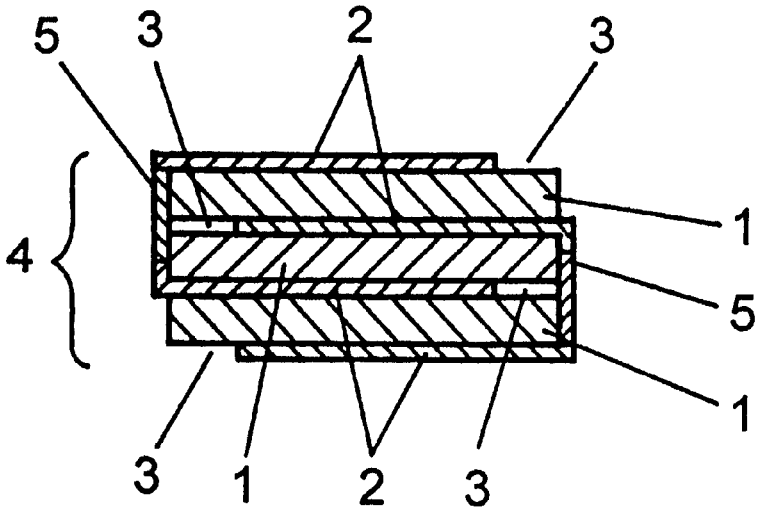
FIG. 10 is a sectional view of a conventional laminated PTC thermistor.

Furthermore, the PTC thermistor of the present invention may be provided with a protective film, as shown in FIG. 9, over the entire top by changing the screen printing pattern of the resin which acts as the protective layer. If there is no electrode, the live part, on a top 91 of the PTC thermistor as shown in FIG. 9, the protective layer has the effect of preventing short-circuiting even if the shielding plate is immediately over the PTC thermistor.

INDUSTRIAL APPLICABILITY

As described above, the PTC thermistor of the present invention comprises a laminated body made by alternately laminating conductive polymer sheets and inner electrodes; outer electrodes provided on the top and the bottoms of the laminated body, and a multi-layered side electrode provided at the center of sides of the laminated body in a way so as to electrically connect with the inner electrodes and the outer electrodes. The sides of the laminated body feature an area with a side electrode and an area without a side electrode. The method of manufacturing PTC thermistors of the present invention repeats the steps of forming the laminated body by sandwiching the top and bottoms of conductive polymer sheet with the metal foil sheets and integrating them by means of a heat pressing; and providing conductive polymer sheets on the top and bottoms of the laminated body, sandwiching these conductive polymer sheets with metal foils, and integrating them by a heat pressing for lamination. With the above configuration, mechanical stress on the side electrode caused by repetitive thermal impact resulting from thermal expansion of the conductive polymer sheet during operation of the PTC thermistor may be reduced at the boundary of the multi-layered side electrode. At the same time, expanded conductive polymer sheet is extruded to an area where no side electrode layer is formed, also reducing the mechanical stress on the side electrode. This is achieved by configuring the multi-layered side electrode, which is electrically coupled to the inner electrode and outer electrode at the center of the sides of the laminated body. The sides of the laminated body are thus provided with an area with and without a side electrode. Accordingly, the occurrence of cracks due to concentration of mechanical stress is preventable, and thus connection failure due to propagation of cracks may be eliminated. The method for manufacturing PTC thermistors in the present invention builds a series of layers by repeating the process of integrating the laminated body, conductive polymer sheets, and metal foils using a heat press. This enables the thickness of conductive polymer sheet in each layer to be made uniform. Accordingly, a PTC thermistor with good withstand voltage is obtained.

What is claimed:

1. A method for manufacturing a PTC thermistor, comprising:

depositing a first metal foil layer on a top surface of a conductive polymer sheet; depositing a second metal foil layer on a bottom surface of the conductive polymer sheet;

forming a first laminated body by heat pressing said first metal foil layer, said conductive polymer sheet and said second metal foil layer;

forming a second laminated body by depositing conductive polymer sheets on a top and a bottom surface of said first laminated body and depositing a third metal foil layer and a fourth metal foil layer on said top and bottom conductive polymer sheets respectively and heat pressing said conductive polymer sheets and said third and fourth metal foil layers on the top and the bottom surfaces of the first laminated body wherein said method is repeated until a desired number of laminated bodies are obtained, "and wherein the first and second laminated bodies are formed non simultaneously."

2. The method for manufacturing a PTC thermistor as defined in claim 1, wherein a nickel protrusion in the form of swelling on a short stalk created by a surface-roughening nickel treatment is formed on the first, second, third, and fourth metal foils at a contacting surface to the conductive polymer sheet, and a nickel coating layer covers said nickel protrusion.

* * * * *